United States Patent [19]

Jacobson et al.

[11] 4,141,139

[45] Feb. 27, 1979

[54] TOOL FOR ASSEMBLING ELECTRICAL CONTACT ASSEMBLY

[75] Inventors: Peter E. Jacobson; Terry S. Allen, both of Phoenix, Ariz.

[73] Assignee: Sperry Rand Corporation, New York, N.Y.

[21] Appl. No.: 828,127

[22] Filed: Aug. 26, 1977

Related U.S. Application Data

[62] Division of Ser. No. 759,298, Jan. 14, 1977, Pat. No. 4,068,909.

[51] Int. Cl.[2] ..... H01R 43/00

[52] U.S. Cl. ..... 29/755; 29/757; 29/758; 29/759

[58] Field of Search ..... 29/755, 757, 758, 759, 29/628; 339/5 R, 5 M

[56] References Cited

U.S. PATENT DOCUMENTS

| | | | |
|---|---|---|---|
| 3,971,460 | 7/1976 | Gay-Chatain et al. | 339/5 R X |
| 4,070,744 | 1/1978 | Hartz, Jr. | 29/757 X |

*Primary Examiner*—Carl E. Hall

*Attorney, Agent, or Firm*—Howard P. Terry

[57] ABSTRACT

A tool for use with a full rotational freedom, substantially zero friction electrical contact assembly of the type disclosed in U.S. Pat. No. 4,068,909 comprising a notched rod of a diameter less than the normal concentric gap between the conductor rings, for receiving conductor loops in hanging relation thereon, the rod being mounted in a support base which includes a guide means for radially and axially positioning the rod within a preassembly eccentric gap between the normally concentric conductor rings. Upon closing the eccentric gap to its normal concentric relation, the loops are captured by the conductor rings and the notched rod is withdrawn.

3 Claims, 16 Drawing Figures

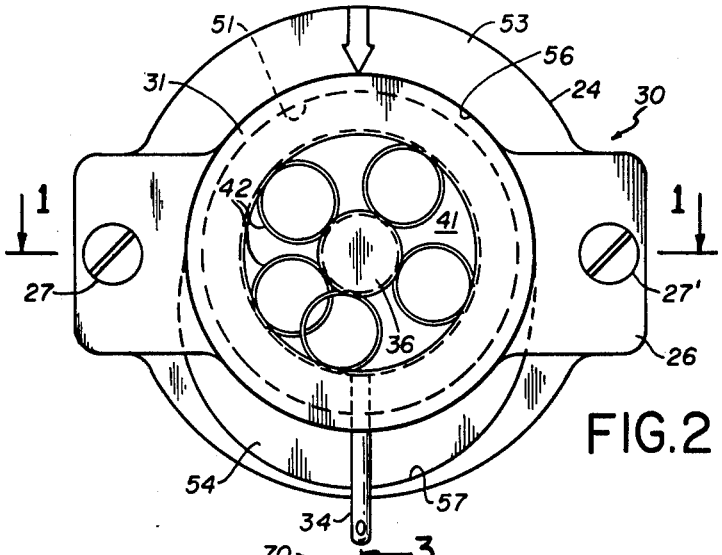
FIG.2
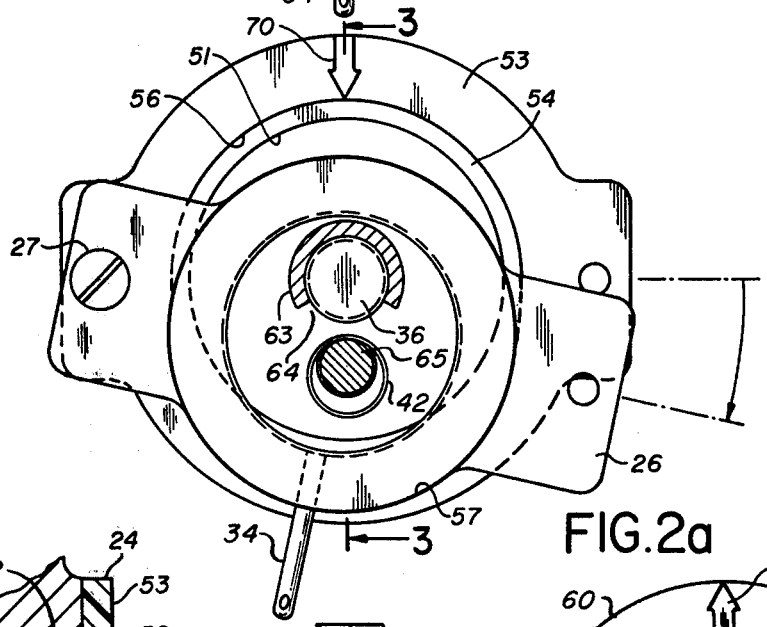
FIG.2a
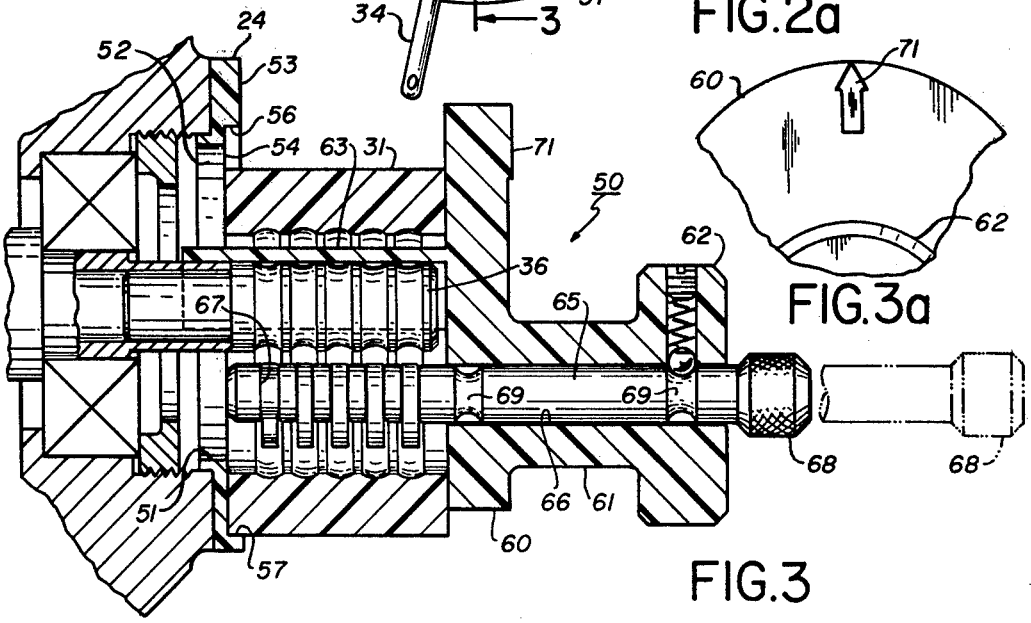
FIG.3
FIG.3a

LOOP AXIAL TRANSLATION

RING AXIAL TRANSLATION

LOOP ANGULAR TRANSLATION ABOUT ASSEMBLY RADIUS

LOOP ANGULAR TRANSLATION OUT OF PLANE TO ROTATION AXIS

CURVES OF CONSTANT PRELOAD ($F_N$)

W=.020 MATERIAL
95% NI. ALLOY
ELAS. MOD. = $30 \times 10^6$
YIELD STRESS = 200,000 PSI

TOOL FOR ASSEMBLING ELECTRICAL CONTACT ASSEMBLY

CROSS REFERENCE TO RELATED APPLICATIONS

This is a division of application Ser. No. 759,298, filed Jan. 14, 1977, now U.S. Pat. No. 4,068,909, entitled "Electrical Contact Assembly and Method and Apparatus for Assembling the Same", in the names of Peter E. Jacobson and Terry S. Allen.

The present application is related to copending application Ser. No. 759,294, now U.S. Pat. No. 4,098,546 entitled "Electrical Contact Assembly", in the names of Harold L. Swartz, Peter E. Jacobson and Robert L. Pirman.

BACKGROUND OF THE INVENTION

1. Field of the Invention

The present invention relates generally to improvements in electrical current transfer devices for transferring electrical current between relatively rotatable members, the broad class of such devices generally being referred to as slip rings. More particularly, the invention relates to improved current transfer devices for conducting currents between stator and rotor members of sensitive instruments, such as between the relatively rotatable gimbals of gyroscopic instruments, for example, characterized by consistent current continuity with practically zero friction and coupling torque. Specifically, the invention relates to current conducting or transfer devices employing resilient filamentary conductor loops which are compressed to predetermined preloads between concentric, coplanar, radially spaced shaped conductor ring contact surfaces on the relatively rotatable members which loops are self captured by and roll on these shaped surfaces upon relative rotation in the presence of any misalignments between the rings or movement of the loop in a vibratory and shock environment while imparting substantially zero torque between the rotatable members.

2 Description of the Prior Art

Rolling electrical assemblies are not broadly new and have heretofore been proposed for use in place of the more conventional slip ring and brush assemblies. The present inventors are aware of two such rolling type contact assemblies and these are disclosed in U.S. Pat. Nos. 2,467,758 and 3,259,727. Also, the present inventors are unaware of any adoption of the assemblies disclosed in these patents by industry in general and particularly by manufacturers of precision sensitive instruments such as gyroscopic instruments. The probable reason is that none of the contact assembly configurations disclosed in these patents are suitable for such applications.

As is well known to those skilled in the gyroscopic arts, slip rings and "hair pin" brushes supported in brush blocks have been used for many years for conducting electrical power and signal currents across the relatively rotatable gimbal axes of gyroscopes. While these have been generally satisfactory, they have been plagued with both manufacture and service use problems, causing fairly high removal rates for repair and overhaul. These assemblies are extremely delicate and require high skill in assembling and time consuming adjustment to achieve a preload consistent with minimum sliding friction in a vibration and shock environment. Also, since they are normally exposed during repair and overhaul of the gyroscope, they are subject to being damaged during handling. In service, especially aircraft service, such gyroscopic devices operate in a vibratory environment and since sliding contact exists between brushes and slip rings, friction polymers tend to build up causing electrical shorting and/or open circuits thereby requiring removal for cleaning and/or replacement; again a delicate, time-consuming and costly operation. More importantly, in autopilot systems which derive aircraft body rates from displacement gyroscopes by differentiation of the gyro displacement signals, electrical noise inherent in this type of slip ring assembly is effectively amplified, rendering the rate signal undesirably noisy and requiring heavy filtering thereby detracting from the rate signal quality. Also in digital encoders, for example, conventional slip rings can produce objectionable digital noise. In addition, as appreciated by those skilled in gyroscopics, slip ring and brush assemblies reduce the long term accuracy of gyroscopes because of the relatively high friction-induced torques produced by the usually large number of slip rings and brushes required in modern electrical gyroscopes.

With the foregoing in view, it will be appreciated that devices for conducting current between relatively rotating members of sensitive instruments, such as across the gimbal axes of gyroscopic instruments, should desirably exhibit the following desirable properties: substantially zero friction and coupling torque; relatively consistent current conduction even in a shock and vibratory environment; long reliable life; low cost of manufacture and assembly; and no vibratory sliding friction contact thereby eliminating friction polymer buildup.

The rolling electrical current conducting devices as disclosed in the above-mentioned prior art patents, while perhaps suitable for some applications, (although the present inventors are unaware of any general application in industry of either of these patented devices) are unsuitable for use in apparatus requiring low friction and coupling torques and capable of producing self retention forces without introducing variable coupling torques between the two relatively rotating members. For example, in the first of the above patents, U.S. Pat. No. 2,467,758, a roller band conductor is disclosed for application as a "slip ring" for an alternating current motor and as a rolling contact for an electrical switch potentiometer or rheostat. It will be noted that in all applications suggested by this patentee, friction or coupling torques imposed by the roller band itself together with its retaining mechanism is clearly not a design consideration at all since in all cases one contact member is driven from a mechanical power source. In many applications, for example, sensitive instruments such as gyroscopes, any friction imposed by the electrical contact devices results in undesired torque on the supported member thereby producing undesired drift or precession and reducing the gyroscopes effectiveness as an accurate, long term reference. Also, in this prior patent, the roller band is not self-captured or self-retained in its orbital path between the conductor rings but requires retaining flanges or pin and hole retaining arrangements. Such flanges, pin-and-hole arrangements and the likeaare completely unsatisfactory in many applications because of the high friction torques and the variable coupling torque magnitude produced by the bands contacting or rubbing against the flanges or pin-and-hole surfaces as it rotates. If a number of circuits are involved, this high and variable torque is correspondingly multiplied making these configurations wholly unsuitable for low torque applications. Also, in this patent, the ratio of the free loop diameter to the radial distance between the inner and outer conductor members is very large so that when the loop is compressed into the radial gap, the loop is highly distorted which results in coupling torque hysteresis and premature metal fatigue and rupture. Also, such distortion may produce buckling and further non-uniform torque. Thus an assembled loop which is highly distorted is not suitable in applications where substantially zero coupling torque is desired or required.

The second of the above-mentioned prior art patents, U.S. Pat. No. 3,259,727, discloses a flexible, rolling element current transfer device in which current transfer characteristics are stated to be improved over that of the first of these prior art patents. This improved current transfer characteristic is stated as being accomplished by making the conductor rings on the relatively movable members in the form of a deep or acute "V" whereby the rolling contact element wedges itself into the "V" groove providing a wiping action to assure good electrical contact. This patent employs a small diameter spring closed upon itself to form a torus, the diameter of which is very large compared to the radial distance between the "V" grooves and therefore, when assembled forms a highly distorted or rolling element which wedges itself into the steep "V" walls hence producing high torque coupling. A flat band is disclosed as an alternative but, like the spring torus, wedges itself between the steep sidewalls of the "V" groove. It is quite evident that the device disclosed in this prior art patent is entirely unsuitable for use in applications which require substantially zero friction and coupling torques to be imposed on the supported rotatable member by the current transfer assembly because of the substantial wiping or rubbing friction and uncompensated bending moments generated as the coil or band enters and leaves the "V" grooves.

From the over-all disclosures of the above prior art patents, none of the rolling contact configurations can exhibit low friction and coupling torque. Furthermore, the above prior art patents disclose no methods, techniques or apparatus for assembling the loops in the radial space between the conductor rings.

SUMMARY OF THE INVENTION

It is therefore an object of the present invention to significantly improve electrical contact apparatus for transferring electrical power and/or signals between a pair of coaxial concentric relatively rotatable members, the improvement resulting in the effective and reliable transfer of electrical energy with substantially zero friction and coupling torques being imparted between the members by the transfer apparatus. The improved apparatus comprises generally an inner circular conductor having a relatively shallow concave conducting surface and a coplanar, concentric outer circular conductor preferably having a similar concave conducting surface, their relative diameters providing a radial space or gap therebetween. An electrically conducting, filamentary loop having a generally flat outside surface is disposed in the radial gap between the concave surfaces of the circular conductors, the ratio between the free diameter of the loop and the radial distance between the circular conductor surfaces, together with the loop thickness and its elastic modulus and yield strength, are such that the loop, when assembled within the gap provides a predetermined preload such as to maintain continuous and redundant surface contact of the loop with the concave surfaces of the circular conductors. Furthermore, when assembled, the loop will roll on the concave surfaces of the circular conductors and be self-captured thereby with substantially zero friction and coupling torque as the circular conductors rotate relatively to one another by reason of the inherent compensation of the bending moments on both halves of a given loop regardless of the preload, providing the loop material yield stress is not exceeded.

A further object of the invention is to provide such electrical current transfer apparatus adapted to operate in a vibratory and shock environment wherein the depth of the concave surfaces of the circular conductors is such that the current transfer loop is self-captured and maintains electrical continuity in such environment without imparting friction and coupling torques on the sensitive instrument due to the capture mechanism.

A still further object of the invention is to provide such an electrical current transfer apparatus for sensitive instruments wherein the current transfer element is self-aligning in the presence of any axial and/or angular misalignment of the contact rings and/or loop, this being accomplished without imparting friction and coupling torques on the sensitive instrument.

A further object of the invention is to provide an electrical current transfer apparatus for sensitive instruments such that normal axial and radial misalignments of the two concave contact surfaces are automatically compensated by reason of the fact that the radii of the two concave surfaces is less than half the radial clearance and the fact that the loaded loop minor and major axes are approximately equal.

Another object of the invention is to provide a method and apparatus by which the conductor loops are assembled within the shoulders of the concave surfaces of the inner and outer circular conductors without deforming, stressing or marring the loops which is important to assuring long reliable operation and smooth and consistent coupling torque.

These and other objects of the present invention not specifically above enumerated will become apparent as a description of a preferred embodiment thereof proceeds, reference being made to the attached drawings.

BRIEF DESCRIPTION OF THE DRAWINGS

FIG. 2 is an end view of the assembly of FIG. 1 with its protective cover removed;

FIG. 2A is an end view of the assembly which has been prepared for the assembly of the loops;

FIGS. 3 and 3A are sectional views of the method and apparatus for assembling the loops between the circular conductors, FIG. 3 being a section taken on lines 3—3 of FIG. 2A;

DESCRIPTION OF THE PREFERRED EMBODIMENT

Figure 1:
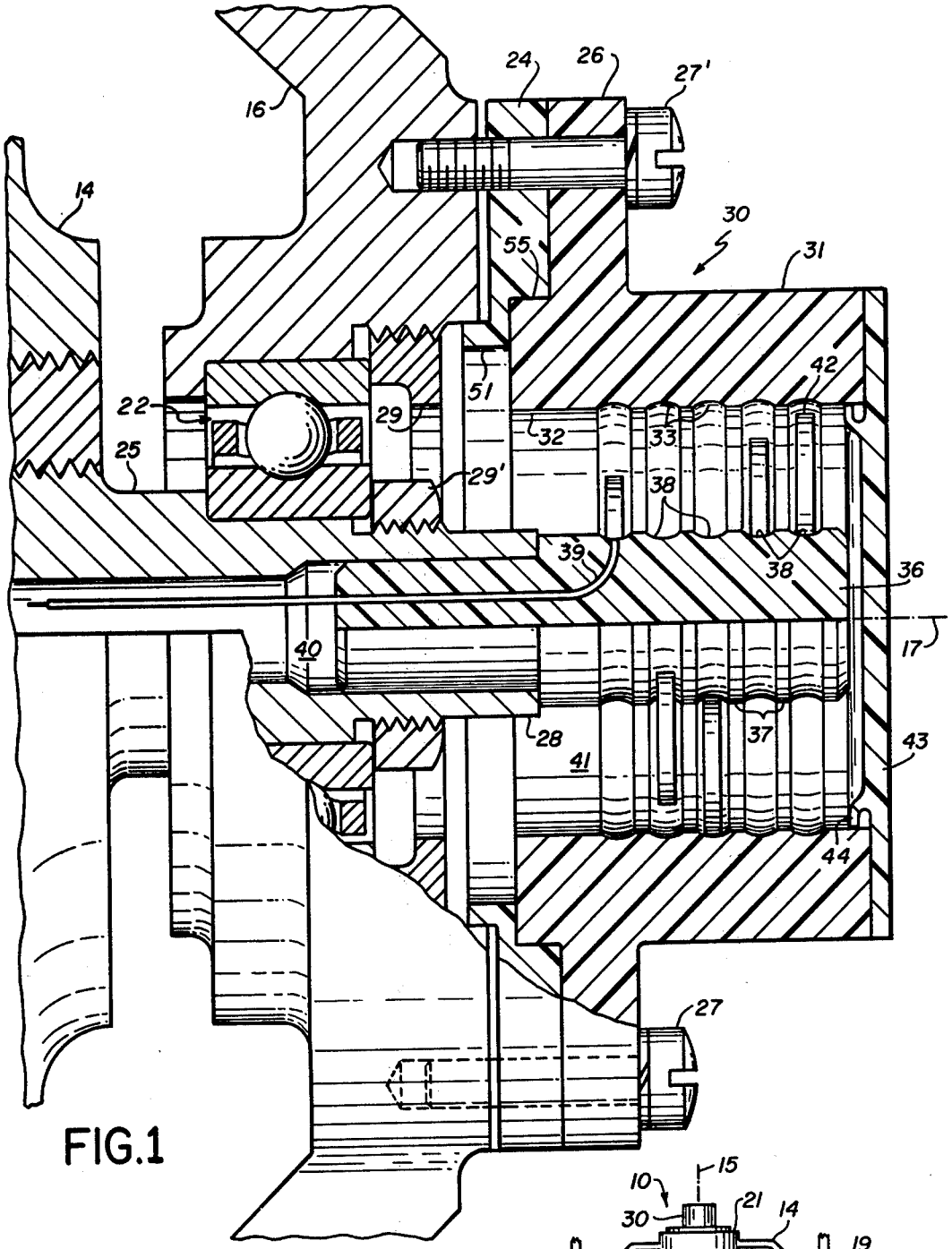
FIG. 1 is a sectional view (taken on line 1—1 of FIG. 2) of the contact assembly of the present invention incorporated at one of the gimbal axes of a gyroscopic device.
Figure 1A:
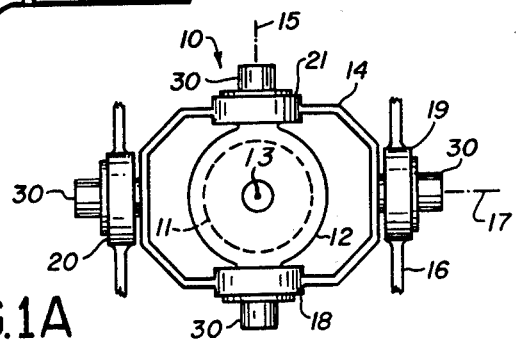
FIG. 1A is a schematic plan view of a typical gyroscopic device.

Referring first to FIG. 1A, there is schematically illustrated a sensitive instrument in which the present invention is particularly useful although it will be understood that it is also useful in any instrument wherein low torque electrical contacts between relatively rotatable members is desired. This instrument is a conventional vertical gyro 10 which comprises generally a rotor 11 journalled by means of suitable spin bearings (not shown) in a rotor case 12 for high speed spinning about a normally vertical axis 13. The rotor case 12 in turn is journalled in a normally horizontal gimbal ring 14 for rotation about a first normally horizontal axis 15 and the gimbal ring 14 is in turn journalled in a fixed housing 16 for rotation about a second horizontal axis 17 normal to the first normally horizontal axis 15. As is well known, if the rotor 11 is spun at high speed and the bearings supporting the gimbals 12 and 14 and the electrical conducting arrangements present zero torque coupling, the rotor spin axis will maintain its position in space indefinitely. Signal generators are normally placed at the gimbal axes and signals proportional to the deviations of the housing 16, for example an airplane, from a horizontal plane may be generated and used for aircraft control and/or indication purposes. Such generators are schematically illustrated at 18 and 19 in the figure. Since frictionless support of the gimbals is not possible, it is necessary to apply torques to the gimbals for erecting the rotor to gravity references and for other control purposes, such torques being applied by means of torquers 20 and 21 as schematically illustrated. Conventionally, the rotor case 12 is supported for rotation about axes 15 and 17 by means of precision ball bearings 22 (FIG. 1). Since modern gyroscopes are usually electrical, that is, the rotor is driven by an electric motor and the signal generator 18 and 19 and torquers 20 and 21 are usually electrical, means must be provided to transfer electrical power and electrical signals between the housing 16 and relatively rotatable gimbal 14 and between gimbal 14 and relatively rotatable rotor case 12. In the past this electrical energy transfer was accomplished by means of a plurality of insulated slip rings mounted on a trunion shaft extending from the bearing support structure and a corresponding plurality of brushes fixed to a brush block secured to the support structure. Each of these brushes usually comprises a pair of very delicate, springy wires carefully bent so as to produce pressure contact (and hence a friction contact) with opposite sides of the slip ring. Since there are usually a great many circuits associated with the operation of the gyroscope which must be accommodated, there are a corresponding number of slip rings and brushes thus multiplying the friction torques. As is well known, the spin axis of the gyroscope will tend to drift from its reference position at a rate determined to the greatest extent by the friction torques existing at the gimbal axes 15 and 17. The precision ball bearings contribute to some extent to the free gyro drift rate but the greater contributors are the slip rings and brushes. If the coupling torque contributed by the electrical energy transfer devices could be substantially reduced to zero, a significant improvement in gyroscope quality would be realized. This is one of the objects of the present invention. Also, since many gyroscopes are used for vehicle stabilization and control they are subject to the shock and vibration environment of the vehicle. It has been found that in such an environment the brushes tend to slide on the surface of the slip rings with the result that friction polymers tend to build up on the contacting surfaces which, given time, will actually lift the brush from the slip ring causing an open circuit. The gyro must then be taken out of service periodically and overhauled, increasing the cost of ownership of the gyro. It is a further object of the present invention to provide a current transfer device which is free of this friction polymer problem. As stated, the brush and slip ring assemblies are extremely delicate; they require great care in initial assembly thereby adding to manufacturing and maintenance costs. Also, great care must be exercised in handling the assembled instrument so as not to damage the exposed delicate brushes. A further object of the present invention is to provide an electrical energy transfer which is comparatively easy to assemble and which is fully protected and shielded.

Referring now to FIG. 1, an enlarged partial section of the gyroscope of FIG. 1A is illustrated, specifically, by way of example, a section of the electrical energy transfer apparatus associated with the support between the gimbal 14 and housing 16. As shown, the stationary gyro housing 16 supports the gimbal 14 in a precision ball bearing 22 through a trunion 25 of the gimbal 14 for rotation about the axis 17. The trunion 25 is hollow and provides a passage for electrical leads from the electrical contact assembly of the invention. Extension 28 of the trunion 25 along the axis of rotation 17 provides a mounting structure for the inner circular conductor of the invention as will be described. A pair of clamping nuts 29, 29' are threaded into housing 16 and extension 28, respectively, and serve to clamp the ball bearing 22 in place.

An electrical contact assembly 30, according to the teachings of the present invention, serves to transfer a plurality of electrical power and/or signals between the stationary housing 16 and the relatively rotatable gimbal 14 with substantially zero friction and coupling torques being applied to the sensitive gyro gimbal. Generally, the contact assembly 30 comprises an outer cylindrical housing 31 preferably a moulded plastic insulating material having a mounting flange 26 secured as by screws 27, 27' through an adapter plate 24, to be further described below, to the outer end surface of the gyro housing or frame 16. Shims may be added as necessary for proper conductor ring alignment. Evenly distributed along the interior surface 32 of the housing 31 are a plurality of circular, concave, conductor rings 33 hereinafter referred to as the outer conductor rings. Each ring, as shown in more detail in FIG. 4, may be of a gold alloy conventionally used for such applications, electro-deposited on concave surfaces 33' of housing 31 and through the plating process electrically connected to a corresponding electrical terminal post 34 moulded in housing 31 to provide an external circuit connection. An inner cylindrical member 36, also of a moulded plastic insulating material is mounted as by epoxy cement in the trunion extension 28. Evenly distributed along the exterior surface 37 of cylindrical member 36 are a corresponding plurality of circular, concave conductor rings 38, hereinafter referred to as the inner conductor rings, each ring also being preferably of gold electro-deposited on corresponding concave surfaces 38′ of member 36 and being similarly electrically connected to a corresponding electrical terminal or wire 39 moulded into member 36, for providing circuit connections to electrical components carried by the gimbal 14. Each inner conductor ring 38 is so located on member 36 that it is accurately aligned with a corresponding outer conductor ring 33 on housing 31 forming a plurality of ring sets (33, 38), whereby all of the ring sets 33, 38 are concentric and coplanar within machining tolerances and with shims as necessary between adapter 24 and gyro base frame 16. The relative diameters of the ring sets, that is, the internal diameter of the housing interior surface 32 relative to the external diameter of the extension member 36, are selected so as to provide a relatively large radial space or radial gap 41 therebetween. In order to seal the contact assembly 30 from dust and other contaminates, and provide protection during handling, a plastic cover 43 may be provided, secured to housing 31 by spring tabs 44 in "hub cap" fashion.

According to the present invention, a corresponding plurality of resilient, electrically conducting, continuous filamentary loops 42 are disposed in the radial gap 41, that is, one loop 42 per ring set 33,38, such that their outer generally flat surfaces contact and roll on the conductive concave surfaces of the concentric rings 33 and 38 thereby providing electrical continuity between the terminal posts 34 and the electrical components on the gimbal 14 through conductors 39. The critical design parameters of the conductor ring surfaces and the loop characteristics will be discussed in detail below; the primary considerations governing the selection of these design parameters being to minimize any torques imposed on the gimbal 14 by the loop/conductor interface, maximizing the retention capability of the loop/-conductor ring interface in a shock and vibratory environment without contributing significant coupling torques, maximizing the current conduction capability of the loop/conductor ring interface, and maximizing the assembly reliability and life.

FIG. 2 is an end view of the contact assembly 30 illustrating the normal random disposition of the conductor loops 42 (after a time period of operation) within the radial space or gap 41. It will be noted from FIGS. 1 and 2 that the delicate loops 42 and ring 33,38 are all interior of the assembly housing 31 and are therefore not exposed to accidental contact or snagging during normal handling of the sensitive gyroscope instrument.

Figure 4:
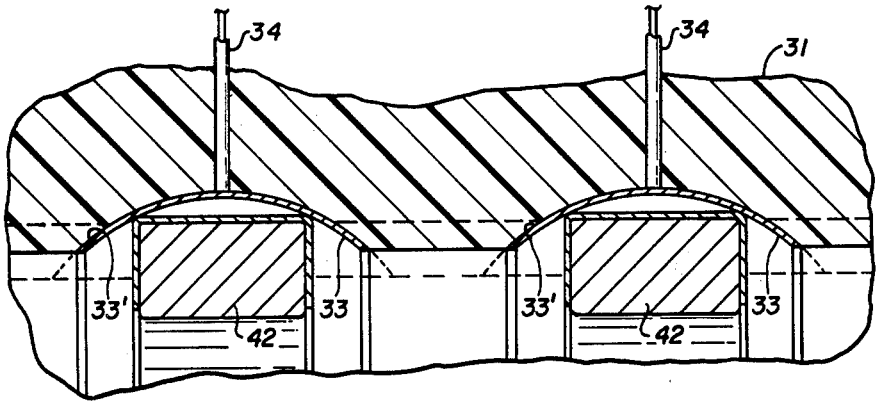
FIG. 4 is a greatly enlarged view of typical conductor loop/conductor ring interfaces.

Referring now to FIG. 4, there is shown a greatly enlarged detailed view of two typical loop/outer conductor ring interfaces, the loop/inner conductor ring interfaces may be substantially the same. The arcuate or concave ring surfaces 33 function to provide a self-capturing and retention capability for the loops 42, the depth of the concavity being selectable depending upon the severity of the shock and vibratory environment in which the gyroscope is to be operated, as will be further described below. It will be understood that in some applications such arcuate surface may need to be formed in but one of the concentric conductor members depending upon the severity of the environment. After the concave grooves 33′ have been machined or otherwise formed to the desired radius and depth they are suitably masked and the gold alloy is electro-deposited on the groove or concave surface to the desired thickness, typically 80 millionths of an inch. Terminals 34 have been cast into the housing mold and cleanly exposed by groove machining so that the gold deposits thereon and provides external electrical connection for the gold rings 33. Alternatively, if desired, separate copper rings may be cast in the plastic housing, machined to the desired concave shape, and then nickel and gold, or other suitable material combinations successively flashed thereon to form the concave conductor rings 33. The conductor loop 42 is also gold plated as illustrated to enhance the electrical conductivity characteristic of the contact assembly.

In accordance with the present invention the loop retention characteristics of the assembly may be readily adapted to a wide range of vibration and shock environments without any constraints by assembly considerations. For example, if the sensitive instrument incorporating the contact assembly is to operate in a quiet or benign environment, the depth of the grooves 33′ may be quite shallow as indicated by the dotted line of FIG. 4, indicating a small arc length, while on the other hand, if the vibration and shock environment is severe, it may be necessary to increase the groove depth, that is, increase the arc length, as indicated by the dot-dash line to prevent loop ejection. Note however, that the relatively shallow radius of curvature remains the same for both cases. The full line illustration is a typical moderate shock and vibration environment such as might be expected in aircraft gyroscopic applications; for example in one airborne gyroscope application, the radius of the groove was 0.025 in. and its depth (for a nickel alloy loop 0.190 in. diameter, 0.020 in thickness and a preload of 0.020 lbs.) was 0.008 in. and none of the loops were ejected when subjected to a random vibration of $0.2g^2/Hz$ amplitude.

While the preferred embodiment of the invention has been illustrated and described with respect to sensitive instruments such as gyroscopes in which, in most cases, the contact assemblies are quite small, there may be many other applications wherein the assemblies are required to be substantially larger and still provide the self-capture capability of the assembly. Therefore, the geometry of the ring concavity, loop dimensions and radial gap may be generalized for adaptation to a variety of applications as follows, reference being made to FIG. 4A. In general, the radius of curvature of the conductor ring surface or groove $R_G$ should be equal to or less than one-half the radial gap dimension, that is, $$R_G \leqq \tfrac{1}{2}(R_o - R_I) \quad (1)$$

wherein $R_o$ is the radius of the point of contact of the loop with the outer ring as defined below, and $R_I$ is the radius of the point of contact of the loop with the inner ring, as defined below.

The dimensions of $R_o$ and $R_I$ are complex functions of the groove radius and loop width as follows:

$$R_o = R_{IG} + R_G[1 - \text{Cos}(\text{Tan}^{-1} 0.5w/R_G)] \quad (2)$$

and $$R_I = R_{OG} - R_G[1 - \text{Cos}(\text{Tan}^{-1} 0.5w/R_G)] \quad (3)$$

wherein $R_{IG}$ is the radius from the assembly axis 17 to the bottom of the inner ring groove, $R_{OG}$ is the radius from the assembly axis 17 to the bottom of the outer ring groove, and W is the width of the loop.

Furthermore, the axial restoring or self-capture forces $F_{AR}$ produces by the loop/ring interfaces may be expressed $$F_{AR} = f(R_o - R_I/2R_G) \quad (4)$$

when $(R_o - R_I/2R_G) > 1$.

Figure 9:
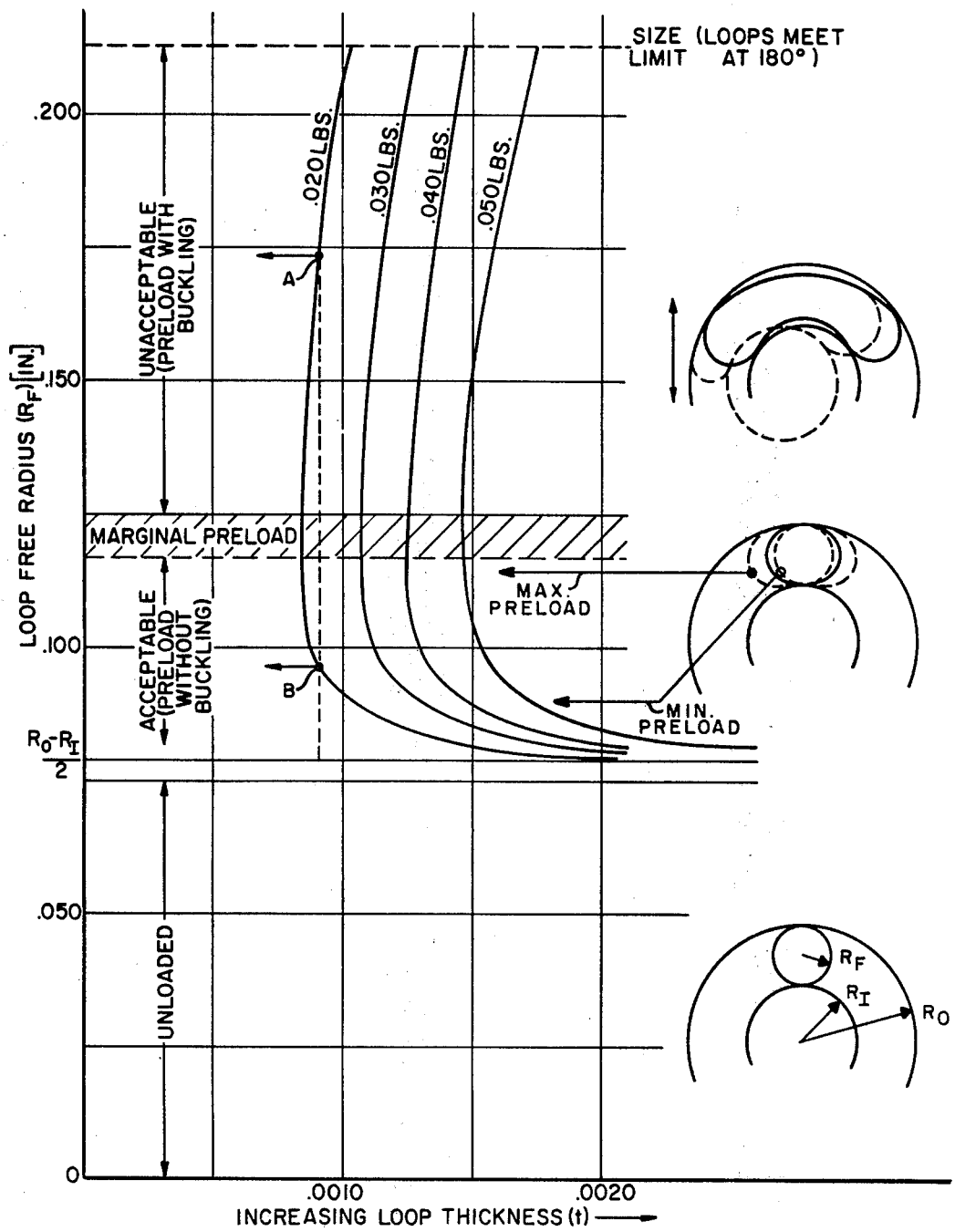
FIGS. 9 and 9A are diagrams useful in understanding the principles of the invention.
Figure 9A:
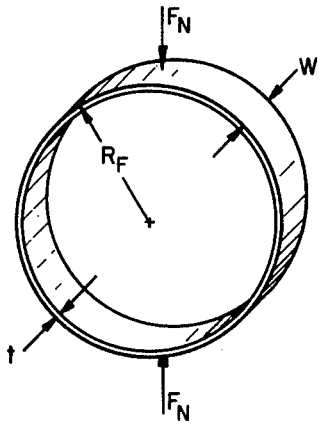

Turning now to the conductor loop 42 design, it will be recalled from above that when assembled into the radial gap 41 the loop free diameter is larger than the radial space between the conductor rings, such free diameter-to-radial space ratio determining the loop preloads. This ratio is chosen such that purely rolling and hence substantially frictionless contact of the loop with the conductor ring surfaces, upon relative rotation between the gimbal 14 and housing 16, is achieved. This criterion is illustrated in FIG. 9 wherein the conductor loop 42 characteristics are selected such that it retains its purely rolling contact with the rings 33 and 38. As will be explained further below, it is recognized that in order for the loop surface to contact the ring surfaces and form point contacts, the loop diameter must in theory exactly equal the radial gap dimension; i.e., the asymptote of FIG. 9. This is, of course, not practical especially in a shock and vibratory environment. There must therefore be a trade-off between the theoretical and the practical loop characteristics, as will be discussed below. It has been found that when the maximum free diameter of the loop is exceeded, it becomes so deformed when assembled between the rings that the loop surfaces do not uniformly contact the conductor ring surfaces and the loop surfaces intermediate to the loop ends tend to buckle or bulge away from their adjacent ring surfaces resulting in positive loop contact at four places along the loop surface as indicated in the upper portion of FIG. 9. By geometry, this means that there is not true rolling contact between the loop and the rings, and interface sliding will occur, thereby generating friction torques. This exaggerated "kidney" or "jelly-bean" shape also tends to overstress the loop material resulting in material fatigue and loop fracture after relatively few rotations resulting in unacceptable useful life. More importantly, such exaggerated "kidney" or "jelly-bean" shape of the assembled loop will produce, upon rotation of the members, uncompensated bending moments in the loop with resultant increase in coupling torques. This may be referred to as torque sensitivity to loop angular position around the gap.

In most practical applications of the invention, and particularly in gyroscopic applications, absolute and continuous concentricity between the inner and outer conductor rings is not achievable due to the characteristics of the supporting ball bearing, machining tolerances, compliances produced by the instrument environment and the like. Thus, the loop diameter is selected so that it provides the desired preload at the maximum eccentric gap position during such anomolies. This means that at the minimum eccentric gap position, the loop preload will be greater than desired. If the loop has too great a free diameter, the radii of the ends of the loop will not be equal and coupling torques will be produced by the loop on the rotatable member. This is illustrated at the top of FIG. 9 by the dotted line position of the exaggerated kidney-shaped loop. Therefore, the desired free loop diameter is such that these loop end radii remain substantially equal even during operations wherein the conductor rings may not be precisely concentric.

In order to achieve the desired loop/ring contact preload without buckling, a number of interrelated loop parameters must be considered. Generally, the gap radial dimension $(R_o - R_I)$, and the loop axial width W are preordained by the desired basic contact assembly dimensions; for example, in one embodiment the gap radial dimension was on the order of 0.20 inch and the axial width W of the loop was on the order of about 0.020 in. Secondly, the loop material is selected. This selection is based on a number of requirements including resistance to deformation, which dictates a material having a high elastic modulus, and a capability of being deformed without fracturing, which dictates a material having a high yield stress. In one embodiment, a successful material was a 95% nickel alloy, which had an elastic modulus of $30 \times 10^6$ and a yield stress of 200,000 psi. Such alloy may be procured from Mechmetals Corporation of Culver City, California. Having selected the above parameters as constants, the remaining dimensions to be determined are the free loop radius $R_F$ and the loop radial thickness t to yield the desired loop/ring preload $F_N$ when deflected by an amount $Y_T$ upon assembly within the gap 41.

At this point it should be noted that with the assembly method and apparatus of the present invention, a wide selection of parameters is available to satisfy a corresponding wide range of environmental requirements. For example, without the present assembly method, the maximum free diameter of the loop, the loop material and possibly its thickness together with the depth of the concave conductor rings are limited by the amount the loop has to be deformed in order to insert it into the radial space between the conductor rings. With the present invention most of the loop and groove design parameters are not limited by mechanical assembly considerations or constraints.

The preload force $F_N$ in pounds may be approximated from the following relationship $$F_N = Y_T E W_F (t/R_F)^3 \quad (5)$$

where $Y_T$ = loop deflection
E = modulus of ring material
$W_F$ = loop width
t = loop thickness
$R_F$ = loop free radius FIG. 9 is a plot of loop thickness t vs loop free radius $R_F$ (where loop width $W_F$ is a constant 0.02 in.; $R_o - R_I$ is 0.150 in.; the loop elastic modulus is $30 \times 10^6$ and yield stress is 200,000 psi) for a family of curves of constant preload $F_N$. It is evident that the maximum preload is a function of the size of the loop and conductor ring diameters and that the maximum desirable preload occurs for a loop free radius of about 0.115 inches. Also, it will be noted that for loop free radii greater than the radius at the maximum desirable preload will result in undesired contact characteristics, i.e., buckling, while for radii less than this, but of course greater than $R_o - R_I$ will provide the desired contact characteristic, i.e., pure rolling contact. Thus, having the parameters $R_o - R_I$ and W predetermined by basic design considerations, any desired preload $F_N$ may be determined; for example, see point A of FIG. 9 given a loop thickness of say 0.0009 in., if a preload of 0.020 lbs. is desired, the free loop radius must be 0.096 in. If a higher preload is desired, say 0.030 lbs., the free radius may be maintained and the thickness increased to about 0.0013 in. It will be noted that for the selected thickness there are two free radii (A, B of FIG. 9) which will provide the desired preload however, one (B) will be so large as to cause the undesired buckling when assembled in the gap. In general, it is best to maintain the loop deflection small by selecting the thickness to achieve a given preload so as to maintain optimum loop bending moment compensation resulting in minimum sensitivity of torque to radial gap changes.

Figure 4A:
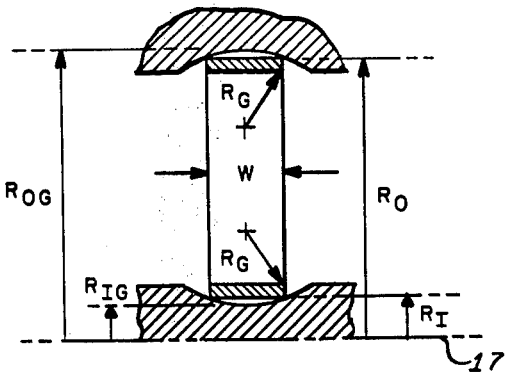
FIG. 4A is a diagram illustrating the generalized geometry of the loop/ring interfaces.

Referring now to FIGS. 5, 6, 7 and 8 and recalling the groove geometry of FIG. 4A, the self-capture and retention capability of the rolling loop conductor assembly will be described. As shown, this self-capture capability is achieved without the use of "V" grooves or vertical guide walls on each side of the conductor rings since in operation such walls would introduce substantial coupling torque. With the present invention, concave, relatively shallow grooves on at least one of the relatively rotatable members in combination with a generally flat outer surface of the conductor loop 42 cooperate to generate force vectors (due to the preload) effective on the loop to maintain it within the grooves. These forces are generated during rolling contact and hence do not significantly contribute coupling torques between the members. Further, such self-retention of the loop is extremely advantageous should the grooves of one member not precisely line up with or be precisely coplanar with the grooves of the other, thereby reducing manufacturing costs. (As stated above, simple shims may be used to attain this alignment with sufficient degree of precision). Also, during operation, should normal motions of the gyro/aircraft tend to axially displace the loops relative to the groove center, they will be self-maintained within the grooves by these restoring faces.

Figure 5:
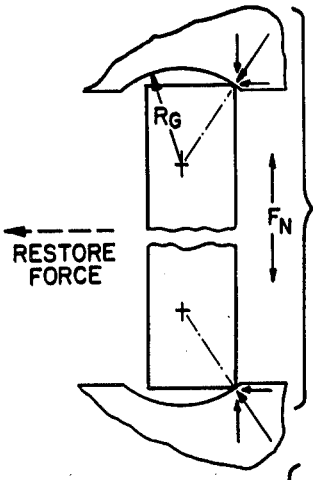
FIGS. 5, 6, 7 and 8 are diagrams illustrating the force vectors and moments by which the conductor loop is self-aligning and self-captured.
Figure 6:
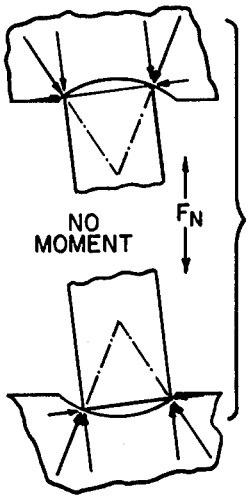
Figure 7:
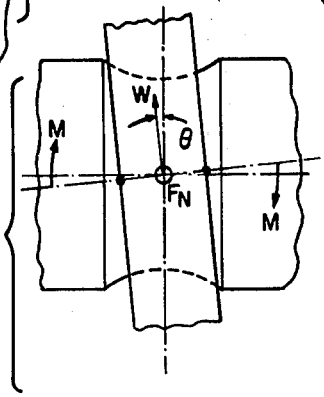
Figure 8:
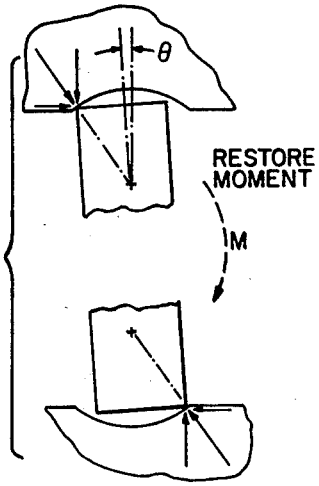

FIGS. 5, 6, 7 and 8 illustrate three typical cases of loop misalignment or disturbance relative to the conductor rings. In FIG. 5, a lateral or axial displacement of the loop (possibly due to a steady turn of the aircraft) is illustrated. The force vector generated by $F_N$ under this situation will include lateral or axial components which create a restoring force and tend to return the loop to an equilibrium force position. In FIG. 6, an axial misalignment (due for example to a non-planar condition between the inner and outer conductor rings) is illustrated. Again, analysis of the force vectors involved show that resultant force components are generated which tend to maintain the loop centered within the grooves. Lastly, in FIGS. 7 and 8 any twisting misalignment, $\theta$ will result in the generation of restoring moments M due to the contact points of the flat surface of the loop with the concave surface of the conductor ring. FIG. 7 illustrates a case wherein the loop has undergone an angular translation about a radius of the assembly while FIG. 8 illustrates a case where the loop has undergone an angular translation out of the plane of the rotation axis.

At this point it should be noted that a rectangular groove or a "V" groove, whether the latter groove is shallow or deep cannot produce the self-capture forces described above when the conductor rings are axially misaligned. Incidentally such axial misalignment may occur during the operation of an aircraft gyroscopic device in the presence of in-flight g-forces. A rectangular groove cannot produce such restoring forces, since the loop simply abuts the groove sidewalls resulting in a distortion of the loop and the production of high friction torques. Likewise, with a "V" groove, even a shallow one, an axial misalignment of the conductor rings will result in forces which are actually divergent; that is, instead of tending to restore the loop into the groove, the forces tend to drive the loop out of the groove.

Another feature of the invention is that the combination of the concave groove and flat outside surface of the loop provides for redundant loop contact points thereby assuring reliable electrical continuity.

In accordance with the teachings of the present invention, the rolling loop conductor assembly is designed so that the detector loops 42 may be assembled is designed so that the delicate loops 42 may be assembled within the radial space between the inner and outer concave conductor rings, 33, 38 without deforming, overstressing, marring or otherwise damaging the same. The latter is extremely important since if the loop, in handling, such as with tweezers or the like, become scratched or nicked, even slightly, each loop surface imperfection becomes a source for torque changes as well as introduces the possibility of a fracture at that point after a short operating time. Furthermore, without the present assembly method and apparatus, the loops would have to be deformed, using some sort of spreading tool in order to insert them into the gap 41. Thus, the spreading tool itself can mar or nick the loop. Additionally, the use of such a tool would require a very skillful assembler to guide the loop into the gap and align the same with the conductor rings, an extremely tedious and time consuming procedure. The present assembly method and apparatus eliminates all of the foregoing assembly problems and may be accomplished by semi-skilled assemblers in a very short time, as will be described. The present assembly method and apparatus also advantageously permits the assembly of loops having various free diameters or preloads, into concave inner and outer conductor rings having various depths depending upon the severity of the vibration and shock environment of the instrument in which it is installed.

The assembly method and apparatus will be described in connection with FIGS. 2, 2A, 3 and 3A. Basically, the method and apparatus involves the design of the adapter plate 24 and an assembly tool or fixture 50 (FIGS. 3 3A). As described above, the adapter plate 24 adapts the housing 31 to the instrument housing or frame 16 by means of screws 27 and 27'. A number of different adapter plates may be designed for different gyro configurations. The plate 24 is generally circular and includes an inner annular lip 51 which ultimately locates and concentrically aligns the conductor assembly with the gyro housing bearing and trunion opening 52. The outer surface 53 of adapter plate 24 includes an outer recessed surface 54 which receives an inner shoulder 55 (FIG. 1) of housing 31 which extends below its securing or mounting flange 26 to the depth of adapter plate recess 54. The flat recess 54 defines a first substantially semi-circular stop 56 (FIGS. 2A and 3) concentric with the lip 51 and bearing and trunion opening 52 and also concentric with the housing's 31 peripheral outer surface thereby defining the normal assembled concentric position of outer conductor ring housing 31 with respect to the inner conductor ring member 36. The flat recess 54 extends beyond the normal position of housing 31 opposite the stop 56 and defines a second radially displaced substantially semi-circular stop 57 concentric with the housing's peripheral outer surface and thereby defines a position for the housing 31 which is eccentric relative to the inner conductor member 36. The over-all shape of recess 54 permits the outer conductor housing 31 to pivot or rotate about one of the assembly securing screws 27, 27', such as screw 27, from a normal or closed position concentric with respect to the inner conductor member 36 to an open or "load" position eccentric with respect to member 36. Thus, in the "load" or open position, a relatively large radial space is provided between one side of the inner and outer conductor rings of the contact assembly. This large radial space permits the assembly of various diameter loops 42. Actually, it can permit the assembly of loops of a diameter providing maximum preload (without buckling, as described above).

Figure 10:
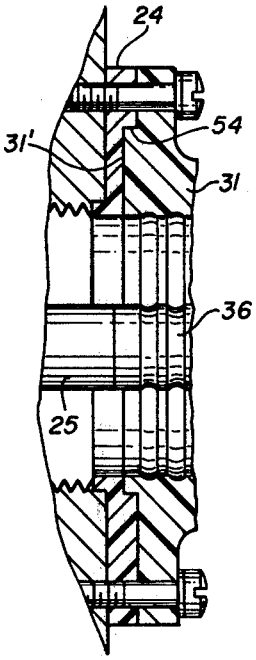
FIGS. 10 and 10A are further sectional views of the method for assembling the invention.
Figure 10A:
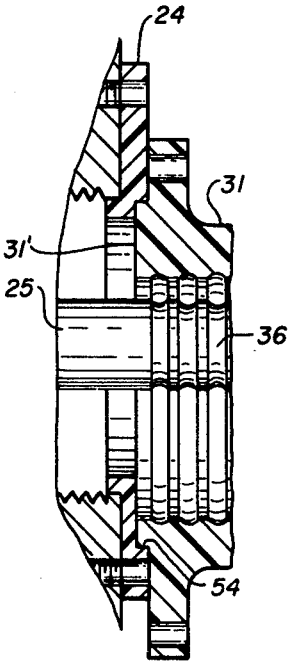

Alternatively, instead of pivoting housing 31 about one of its mounting screws as illustrated in FIGS. 2, 2A and 3, the recess 54 of adapter plate 24, as shown in FIGS. 10 and 10A, may be eccentric with respect to trunion 25 and inner conductor member 36 and an extension 31' of housing 31 may fit within the recess 54 and be correspondingly eccentrically located relative to the housing 31 internal axis of symmetry, such that in its normal position its internal axis of symmetry is aligned with the axis of the inner member 36. Thus rotation of the adapter 24 (before the mounting screws 27, 27' are inserted) will eccentrically displace the housing 31 thereby providing the enlarged radial space for assembly of the loops according to the present invention as shown in FIG. 10A.

The loop assembly apparatus of tool 50 is illustrated in FIGS. 2, 3 and 3A and in use permits the loops 42 to be quickly assembled without handling with tweezers or other sharp objects which might mar or nick the same. The tool 50 is preferably moulded from a suitable plastic material and comprises a circular base flange portion 60 having a diameter larger than and adapted to bridge the internal diameter of housing 31 so that the housing's external face serves as an axial alignment stop or axial positioning means for the tool when in use. An extension or hub 61 and a knob 62 on one side of the base flange permit the tool to be easily handled and manipulated. Extending from the center of the opposite side of the base flange 60 is a hollow cylinder or guide member or means 63 having an internal diameter permitting a sliding fit over the inner conductor member 36 and of a sufficient length to extend preferably beyond the innermost inner conductor 38 of the member 36. A portion of the side of cylinder 63 facing the enlarged gap 41 is cut away, as at 64 in FIG. 2A, to permit engagement of the loops with the inner conductor rings 38 as will be described. Laterally or radially displaced from the cylinder 63 and opposite the cut away portion thereof is a rod 65 preferably of plastic material, fitted in a mounting hole 66 in the base 60 extension or hub 61. As shown, the rod has a thickness or diameter substantially less than the normal gap 41 and at its one end is provided with a plurality of recesses or notches 67, spaced according to the ring spacing, and at its other end a suitable knob 68. The rod may be slidably fitted in hole 66 and suitable low pressure ball and detent arrangements 69 may be provided for establishing positive axial rod positions in use. It will be understood, however, that the rod 65 alone may be used without departing from the scope of the invention, the assembler manually guiding the rod into the widened gap 41.

In operation, the assembler, preferably in a clean room, scatters some loops from their containers onto a soft, lint-free surface (such as sponge rubber or sponge plastic) and using the tool 50 with the rod 65 in its extended detent position, (which aligns the recesses 67 with the ring pairs during assembly, as described herein), picks up at least the number of loops to be loaded on the rod end and manipulates the tool, as by tapping, such that one loop hangs freely in each of the recesses 67. The end of cylinder 63 is placed on the outer end of inner member 36 with the axis of member 36 aligned horizontally, and rotated so that an arrow or marker 70 disposed on plate 24 is aligned with an arrow or marker 71 disposed on the flange 60 (thereby assuring proper alignment of rod 65 within the enlarged radial opening 41) and then fully advances the tool 50 until the inner surface of flange 60 abuts the outer surface of housing 31. Now, all of the loops are aligned coplanar with their corresponding inner and outer conductor rings 33, 38. The assembler then rotates the housing 31 on screw 27 so that the shoulder 55 abuts the recess stop 56 to thereby compress the loops between the conductor rings establishing the designed preload. The screw 27' is inserted through the hole in the mounting flange 26 of housing 31 and the hole in adapter 24 and preferably lightly tightens the screw. The assembler then withdraws rod 75, with the tool still held in place, so as to assure that the rod does not inadvertently contact any of the loops upon removal. Finally, the tool 50 is carefully removed without rotating so that the open walls of cylinder 63 do not contact the loops and both screws 27 and 27' are tightened to the desired torque. The protective cap 43 is snapped in place to seal the interior of the assembly from any foreign matter.

While in the foregoing have been described specific embodiments of the present invention, it will be understood that other embodiments thereof may be made without departing from the true scope and spirit of the invention. For example, in the assembly method and apparatus, the adapter plate 24 may be dispensed with if desired and the guide and stop means 54, 56 and 57 may be incorporated directly in the support member. Also, other guide and stop means or arrangements may be employed; for example, the plate 24 with its recess 54 and stop 56, 57 may be dispensed with and a simple pin and arcuate slot arrangement used. In this case, the pin may be secured in the support member 16 and extend through an arcuate slot in one of the flanges 26, the ends of the slot providing stops which determine the pivotal movement of the ring housing 31 between its normal coaxial position and its "load" or eccentric position.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. For use with a contact assembly for conducting electrical energy between a pair of coaxial instrument members relatively rotatable about an axis thereof of the type comprising a plurality of inner and outer circular, coaxial, coplanar electrically conductive rings, one group of said rings being disposed on one of said members and the other group of said rings on the other of said members for relative rotation about said axis, the respective diameters of said rings providing a relatively large radial gap therebetween and a plurality of resilient, filamentary, electrically conductive loops having a free diameter greater than the radius of said gap and normally compressed between the rings whereby the loops roll on the ring surfaces upon relative rotation between the instrument members, the assembly further comprising inner and outer cylindrical support members for the inner and outer rings and carried by said instrument members, one support member being radially fixedly mounted on one of said instrument members relative to said axis, and the other support member being movably mounted on the other of said instrument members between a normal coaxial position relative to said one support member and an eccentric position relative to said one support member, the amount of said movement providing an enlarged radial gap greater than the free diameter of said loop, whereby said loop may be assembled within said gap at said eccentric position without distorting the same and is compressed between said rings at said normal position; a tool for assembling said loops within said gap comprising:

an elongated, rod-like element having a thickness substantially less than the normal radial gap between said rings, a plurality of notches at one end of said element axially distributed along the surface thereof corresponding to the axial distribution of said rings for receiving a corresponding plurality of loops in hanging relation thereon and the other end including means for moving said element by an operator, means for guiding said rod with said loops in place into said enlarged gap with said loops aligned with said rings, whereby with said other ring support member in its normal coaxial position relative to said one ring support member, said rod-like member may be freely withdrawn from said normal gap leaving said loops compressed between said rings.

2. The assembly tool as set forth in claim 1 further comprising a base member having a radially extending flange portion and including means for axially positioning said rod-like element such that said notches are axially aligned with said rings, guide means extending from said flange portion for engaging said inner ring support member and being radially positioned thereby relative to said axis, and means supporting said rod-like element on said base member radially displaced from said guide means by an amount such that said element lies freely within said normal radial gap.

3. The assembly tool as set forth in claim 2 wherein said means supporting said rod-like element on said base member comprises a hub extending from said flange portion on its side opposite said guide means, an opening in said hub extension for receiving the end of said rod-like element opposite said notched end and extending exteriorly of said hub extension for manipulation by the operator, whereby said notched end of said said rod-like element may be removed from within said gap when said ring support members are in their normal coaxial position with said loops compressed between said conductor rings.

* * * * *